US005737960A

United States Patent [19]

Brandstetter et al.

[11] Patent Number: 5,737,960

[45] Date of Patent: Apr. 14, 1998

[54] PRESS WITH A COMBINATION TRANSFER SYSTEM

[75] Inventors: Rudi Brandstetter, Adelberg; Hans Hofele, Goeppingen, both of Germany; Herbert Plocher, Columbus, Ohio

[73] Assignee: Schuler Pressen GmbH & Co., Germany

[21] Appl. No.: 748,579

[22] Filed: Nov. 13, 1996

[30] Foreign Application Priority Data

Nov. 13, 1995 [DE] Germany ..... 195 42 205.8

[51] Int. Cl.[6] ..... B21D 43/05

[52] U.S. Cl. ..... 72/405.16; 72/405.1; 72/405.11

[58] Field of Search ..... 72/405.01, 405.1, 72/405.11–405.16

[56] References Cited

U.S. PATENT DOCUMENTS

| | | | |
|---|---|---|---|
| 4,272,981 | 6/1981 | Endter | 72/405.12 |
| 4,653,311 | 3/1987 | Tack | 72/405.11 |
| 4,753,103 | 6/1988 | Braun | 72/405.11 |
| 4,941,793 | 7/1990 | Shiraishi | 72/405.1 |

FOREIGN PATENT DOCUMENTS

| | | |
|---|---|---|
| 0 621 092 A1 | 10/1994 | European Pat. Off. . |
| 25 24 009 A1 | 5/1975 | Germany . |
| 25 24 009 | 12/1976 | Germany . |
| 38 24 058 C1 | 11/1989 | Germany . |
| 44 08 449 A1 | 9/1995 | Germany . |
| 2 243 134 | 10/1991 | United Kingdom . |

*Primary Examiner*—Daniel C. Crane

*Attorney, Agent, or Firm*—Evenson, McKeown, Edwards & Lenahan, P.L.L.C.

[57] ABSTRACT

A press with several press stations is provided for serially machining larger sheet metal parts. A transfer unit transports workpieces through the press stations which are arranged behind one another in the machining sequence. The transfer unit has a first section constructed as a three-axis transfer and a second section constructed as a cross-traverse transfer. The three-axis transfer has a pair of mutually parallel gripper rails with gripper devices which, by way of a lateral feeding movement of the gripper rails can be engaged with and disengaged from the workpieces. The cross-traverse transfer has a pair of mutually parallel transport rails which are connected with one another by cross-traverses provided with gripper devices for the workpieces. The cross-traverse transfer has parking positions between individual press stations in which the cross-traverses remain during the operation of the press stations.

20 Claims, 5 Drawing Sheets

PRESS WITH A COMBINATION TRANSFER SYSTEM

BACKGROUND AND SUMMARY OF THE INVENTION

The present invention relates to a press having several press stations for serially machining preferably larger sheet metal parts in the press stations which are arranged along a transport direction.

In presses having several press stations arranged behind one another in the transport direction, usually larger sheet metal plates are transferred from press station to press station and are subject to another machining in each of these press stations. Thereby, the workpieces arrive at the output of the process which were produced from sheet metal plates by a multiple deforming and/or cutting. The resulting workpieces considerably differ in their exterior shape and in their dimensions from the sheet metal plates fed to the press.

In presses of this known type, a transfer system is normally provided by way of which the workpieces are increasingly deformed in the successive machining stations and are conveyed further from press station to press station. The parts pass through cutting as well as deforming stations, in which, particularly in the cutting stations, the outer contours of the workpieces can be changed considerably.

DE 25 24 009 A 1 shows a system for transporting workpieces step-by-step along several stations of a press contains cutting as well as deforming stations. For transporting the workpieces, a three-axis transfer system is used which has two gripper rail pairs. The gripper rails of the first gripper rail pair are arranged at a relatively large lateral distance from one another and are used for transporting relatively wide workpieces, for example, in the case of the introduction of these workpieces into a cutting station. The gripper rails, which are arranged at a narrow lateral distance to one another, extend below the bottom die of a respective press station and are used for receiving a cut-out workpiece which is passed through the bottom die in the downward direction. The gripper rails arranged at a large lateral distance with respect to one another as well as the gripper rails arranged at a narrow distance in parallel to one another extend along several press stations.

For the transport of the workpieces in this known system, the gripper rails carry out a timed longitudinal movement. For receiving and releasing the workpieces, a driving device is provided for moving the gripper rails of each gripper rail pair toward and away from one another. The driving device is configured such that the movement of the gripper rails extending in the transverse direction takes place synchronously in the opening and closing direction. The gripper rails arranged at the larger distance in this case travel along a longer path than the gripper rails arranged at a shorter distance. A gear drive ensures the relationship between the two movements. Recesses for the guiding-through of the gripper rails are required in the bottom dies. In addition, considerable space is needed for the total of four gripper rails guided in parallel to one another.

It is an object of the present invention to provide a space-saving press with a system for the automatic transfer of the workpieces from press station to press station.

According to the present invention in a press with several press stations, a transfer unit is provided which, in a first press area, has two gripper rails which are arranged essentially parallel to one another as well as parallel to the transport direction, and which are equipped with gripping devices. In addition, driving devices interact with these gripper rails for moving the gripper rails toward and away from one another as well as at a constant distance from one another in a direction which is situated at a right angle with respect to the transport direction and finally in the transport direction.

In addition, the transfer unit has two transport rails arranged in a second press area which follow the gripper rails in the transport direction and are arranged at a distance in parallel to one another, as well as second driving devices. The driving devices provide for movement of the transport rails at a constant distance from one another in a direction which is situated at a right angle to the transport direction as well as in the transport direction. The gripper rails carry traverses which are arranged transverse to the transport direction and are provided with gripper devices.

Accordingly, the press is provided with a transfer device which contains two transfer systems which operate essentially independently of one another. The first transfer system is formed by the two gripper rails which are arranged in a first press area and are arranged essentially parallel to one another and parallel to the transport direction. These gripper rails can also be moved by the respective driving devices in the longitudinal direction, which corresponds to the actual transport movement, as well as in the lateral direction. That is, they are moved toward and away from one another as well as in the vertical direction, in which case they are moved with a constant spacing perpendicularly to the transport direction. The last-mentioned movement is normally a lifting and lowering movement which takes place in the vertical direction. This movement is used for lifting workpieces out of corresponding bottom dies and for inserting them therein. The lateral moving component is used for the opening and closing, whereby the gripper devices carried by the gripper rails are engaged with the workpiece during the closing and are separated from the workpiece during the opening. The transport movement therefore takes place with mutually approached gripper rails while the return movement takes place with gripper rails which are away from one another.

This section of the transfer system is used mainly for the transport of the workpieces through press stations in which the outer contour of the workpiece is still largely similar to the metal sheet originally introduced into the press. In particular, it is important that the dimension transverse to the transport direction, that is, the width of the workpiece and therefore the outer edges of the pertaining bottom dies in this area, are not very far away from one another.

Instead of the gripper rails, transport rails are arranged in the second press area which are connected with one another by traverses. The traverses carry gripper devices, such as suction devices, suction spiders, or the like. The transport rails are equipped with driving devices which can provide these with a lifting and lowering movement as well as with an advancing movement. During the normal operation of the press, the distance of the transport rails with respect to one another does not change.

The section of the transfer system formed by the transport rails extends through a press area in which bottom dies are required, that is, sliding tables of a larger width or of a larger lateral spacing of the outer edges with respect to one another. Such bottom dies or sliding tables are particularly arranged in press areas in which cutting stations are provided or which follow cutting stations. If several workpieces are cut off a sheet metal plate which are to be moved in a timed manner in parallel to one another through press stations which follow, the required total width of the press can be reduced in comparison to an operation with a pure three-axis transfer. The workpieces are gripped, for example, from above by the gripper devices fastened on the traverses so that no space is required for gripping devices operating from the side or for gripper rails moving sideways. In this area, the bottom dies and the sliding tables can therefore fully utilize the available width in the press.

In contrast, in the first press area, the length available in the transport direction is utilized in an optimal manner. Because of the possible lateral access of the gripper devices to the workpieces, no longitudinal sections between the press stations are required which are used as waiting positions for any gripper devices.

The transfer unit comprising a three-axis transfer system and a transfer system with traverses permits, for a given machining sequence, the construction of a very compact press with an overall rectangular plan form in the case of which the width measured transversely to the transport direction as well as the length measured along the transport direction are minimized. Therefore, because of its dimensions, the press with the above-mentioned transport system can be produced in a compact manner at reasonable cost.

The driving devices are advantageously configured such that the gripper rails and the transport rails can be moved independently of one another. As a result, the return movement of the three-axis transfer which is formed by the gripper rails can take place when the transport rails which form a two-axis transfer are in the parked position.

The gripper rails are driven by two driving units. One of the units is a lifting and closing unit which controls the lateral movement of the gripper rails as well as their lifting and lowering movement. The other unit is an advancing device which moves the gripper rails in the transport direction. This separation into different driving units permits an optimal configuration of the respective driving device for the given purpose. As a result, the respective occurring moving curves for the different moving directions can be optimized and the accelerations can therefore be minimized. For the uncoupling of the longitudinal movement of the gripper rails from their lifting and transverse movement, a linear guide can be used. The gripper rail then is connected by way of a telescope-type device with the lifting and closing device.

The gripper devices carried by the gripper rails can be fastened to separate supports which are detachably fastened to the gripper rails. This arrangement makes it possible to also exchange the gripper devices during a tool change in a simple manner. The same applies to the traverses which can also be detachably connected with the transport rails. For this purpose, coupling devices are used which, in the case of a lateral, outwardly directed movement of the transport rails, uncouple the traverses from these.

Also for the transport rails, a driving device provided for the transport movement and a separate driving device can be provided which carries out the lifting and lowering of the transport rails corresponding to the given transfer curve. In addition, the device carrying out the lifting and lowering of the transport rail can be constructed as a lifting and closing device which can provide the transport rails additionally with a lateral movement for separating the transport rails from the traverses.

A good space utilization is obtained when the distance of the transport rails from one another is essentially equal to the distance between the gripper rails when these are in the position farthest away from one another. The maximal space is obtained in both machine sections which is available for the sliding tables or the bottom dies.

The gripper rails are part of a first transfer system which is preferably arranged in an area which is situated upstream relative to the transport direction and in which frequently deep- drawing stations or similar deforming stations are arranged. The section of the transfer system which contains the transport rails is preferably situated downstream in the area of separating or cutting stations. The moving curves along which the two transfer systems pass can in each case be optimized separately, in which it is advantageous for the moving sequences to be coordinated with one another. The second transport system with the traverses, which by nature is slightly slower, is configured for maximal speed if the resulting precision is sufficient. The speed can be at 15 to 16 strokes per minute. The first transfer system with the three-axis transfer, which per se has a higher speed potential, can, however, be configured instead for maximal precision or minimal energy consumption.

Although it is possible in principle to provide several transport systems, i.e., more than two, along the length of the press each of which, according to the requirements, is configured as three-axis transfer systems with gripper rails or as transfer systems with transport rails and traverses, it is expedient for most applications to provide only two transfer systems which are separated from one another. Then the gripper rails as well as the transport rails each extend along several press stations.

A press which is variable and versatile with respect to the positioning of the workpieces to be transported is obtained if the gripper devices provided on the traverses are disposed on the traverses to be displaceable transversely to the transport direction. A corresponding positioning of the gripper devices is achieved by connecting each of them with an adjusting arrangement which permits a targeted movement of the corresponding gripper devices with respect to the traverse. After several individual parts were cut in a cutting station, for example, out of a workpiece, these were brought to a corresponding lateral distance by the gripper devices and machined at a distance from one another in the deforming stations which follow.

BRIEF DESCRIPTION OF THE DRAWINGS

These and other objects, features and advantages of the present invention will become more readily apparent from the following detailed description of currently preferred embodiments when taken in conjunction with the accompanying drawings wherein.

DETAILED DESCRIPTION OF THE DRAWINGS

Figure 1:
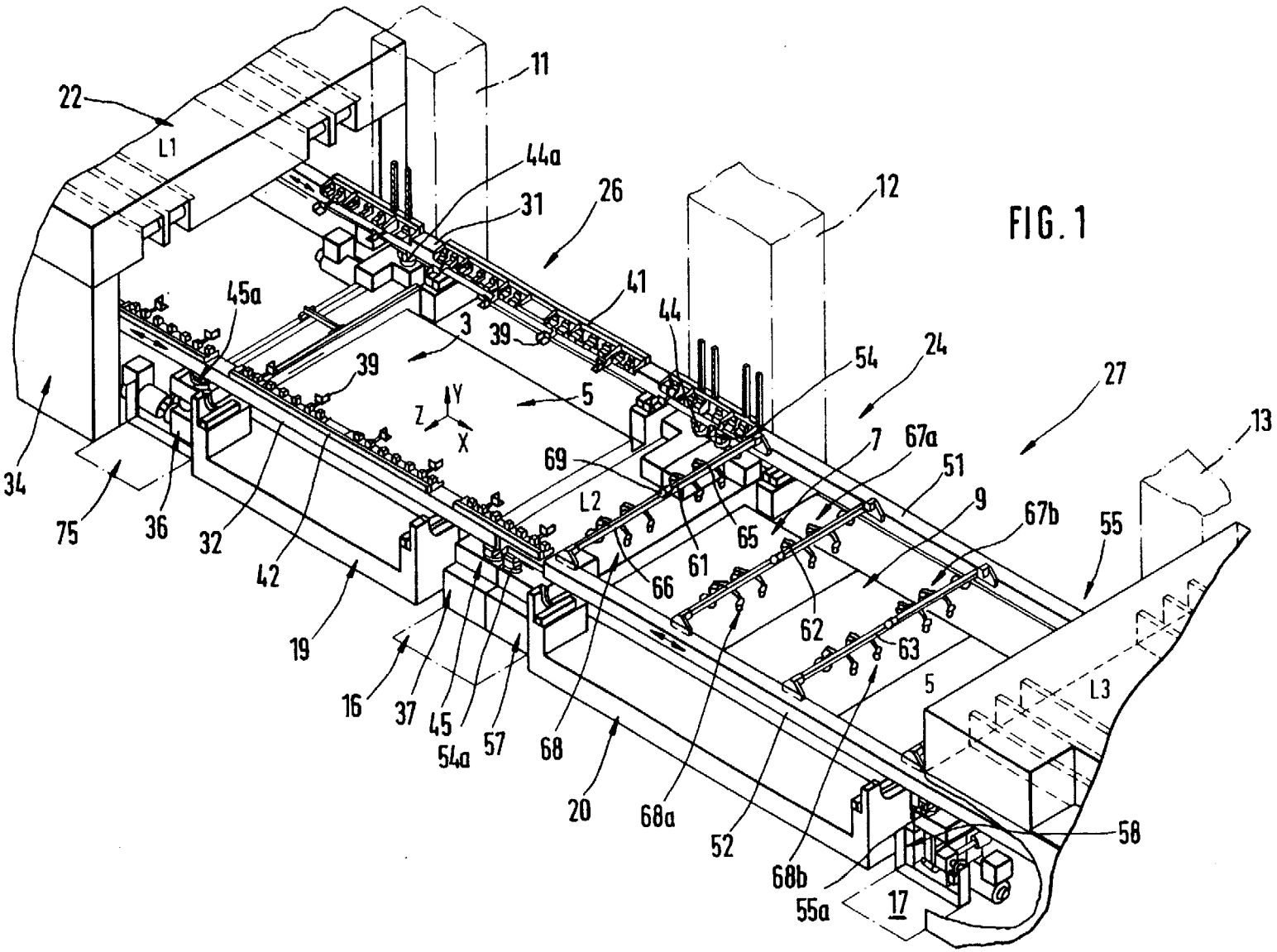
FIG. 1 is a schematic, partially cutaway perspective view of a press with several press stations and a first transfer unit constructed as a three-axis transfer system, as well as with a second transfer unit constructed as a suction bridge transfer system.

The press shown in FIG. 1 is a multistation transfer press with a total of four successive press stations 3, 5, 7, 9, each including a bottom die as well as a slide of known construction which is movable up and down and, via a corresponding driving unit, away from and toward the corresponding bottom die in a power-operated manner. The slides are guided in a machine frame and are driven by a driving device which is supported by way of columns 11, 12, 13 as well as by additional columns which are shown schematically in FIG. 1 by their outlines 15, 16, 17. The slides and therefore the press stations 3, 5, 7, 9 operative synchronously.

The bottom dies, which are part of each press station 3, 5, 7, 9, are disposed on sliding tables, each of which includes a corresponding base frame 19, 20, on which the sliding tables can be displaced laterally. That is, the sliding tables can be displaced in the Z-direction indicated by the intersection of axes X-Y-Z and, as required, can be locked. For the further transport of workpieces, which were introduced into the multistation transfer press 1 by a feeding device 22, a transfer unit 24 is used which contains a first transfer system 26 and a second transfer system 27. Relative to the transport direction indicated by the X-direction of the intersection of axes X-Y-Z, the first transfer system 26 is arranged upstream and the second transfer system 27 is arranged downstream relative to the transport direction. The transfer system 26 therefore extends through a first section of the multistation transfer press 1 and the second transfer system 27 extends through a second section. In the first section of the multistation transfer press 1, i.e., in the press stations 3 and 5, deforming steps are carried out on the workpieces, such as deep-drawing, or the like. In the following second section of the multistation transfer press 1, i.e., in the press stages 7 and 9, cutting operations, separating machining steps as well as, if required, further deforming steps are carried out.

The first transfer system 26 situated upstream in the transport direction X is constructed as a three-axis transfer system and has two gripper rails 31, 32 which are spaced and synchronously moved parallel to one another. For transporting the workpieces, the gripper rails 31, 32 each travel along a transfer curve in whose course, they are moved in the X-direction as well as in the Y-direction and in the Z-direction. The movement in the X-direction which is used as the actual transport movement is provided to the gripper rails 31, 32 synchronously by an advancing device 34 which is shown schematically in FIG. 1. For laterally adjusting the gripper rails 31, 32, i.e., for moving the gripper rails 31, 32 in the Z-direction, and also for adjusting the gripper rails 31, 32 in the Y-direction, i.e., for the synchronous lifting and lowering of the gripper rails 31, 32, closing boxes 36, 37 are arranged in front of and behind the base frame 19 of the corresponding sliding table. The gripper rails 31, 32 are provided with grippers 39 which are arranged on corresponding supports 41, 42. As required, these can be separated from the gripper rails 31, 32.

For uncoupling the longitudinal movement of the gripper rails 31, 32 in the X-direction from their lifting and transverse movement in the Y- or Z-direction, each gripper rail 31, 32 is connected with the respective closing box 36, 37 by way of a corresponding telescopically constructed linear guide 44, **44*a*, 45, 45*a* to ensure that the gripper rails 31, 32, as predetermined by the advancing device 34, move in the longitudinal direction relative to the closing boxes 36, 37**.

In contrast, the transfer system 27 is constructed as a suction traverse transfer system and has two transport rails 51, 52 which are spaced parallel to one another. On the end side, each of the transport rails 51, 52 is connected with an advancing unit 53 and, by way of telescopically constructed linear guides 54, **54*a*, 55, 55*a*, with closing boxes 57, 58 which are operated essentially as lifting units. The transport rails 51, 52 are connected with one another by traverses 61, 62, 63 which extend transversely to the transport direction (X-direction) and are spaced away from one another and are detachably held on the transport rails 51, 52 by coupling devices. The traverses 61, 62, 63 are detached from the transport rails 51, 52 by moving the rails 51, 52 away from one another in the Z-direction by way of the closing boxes 57, 58, so that the traverses 61, 62, 63 detach from the transport rails 51, 52. The advancing unit 53 drives the transport rails 51, 52** synchronously along (i.e., in and against) the X-direction.

The traverse 61 is provided with two carriages 65, 66 which are displaceable in the Z-direction and each carry vacuum grippers 67, 68. The carriages can be adjusted in the Z-direction by a driving device 69. The other traverses 62, 63 have the same construction as the above-described traverse 61. The corresponding carriages, vacuum grippers and driving devices are therefore provided without another description and use the same reference numerals with an "a" or a "b" added for the purpose of differentiation. No further detailed explanation for these parts is therefore necessary.

Figure 2:
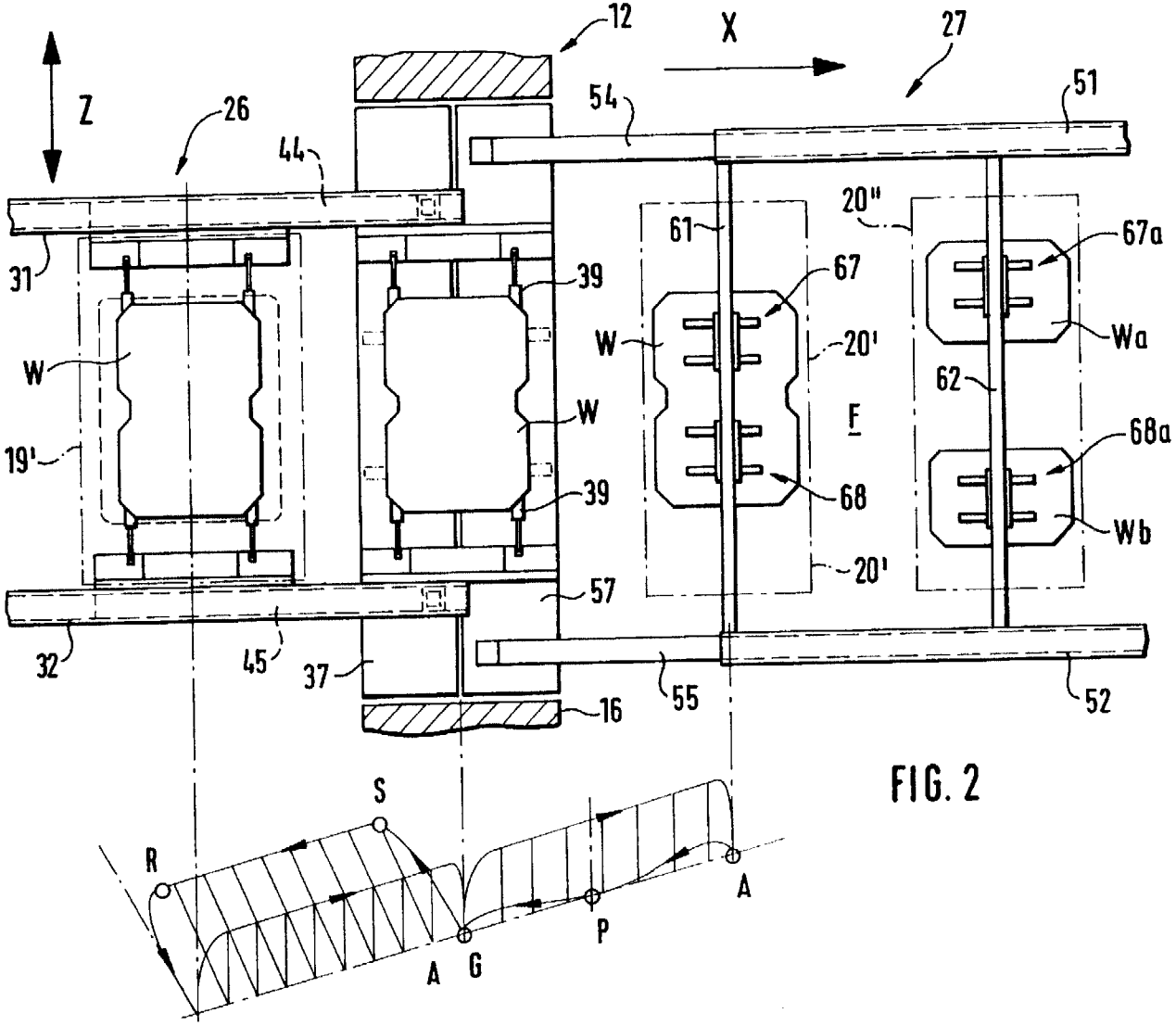
FIG. 2 is a schematic, cutout-type plan view of the press of FIG. 1 in a first operating position, and a schematic representation of the transfer curves travelled by the transfer systems.

In the following description of the method of operation and the determination of the dimensions of the transfer systems 26, 27 of the multistation transfer press 1, reference is made to FIGS. 2, 3, 4 and 5 in which the multistation transfer press 1 is schematically illustrated. As illustrated in FIG. 2, the closing boxes 37, 57 arranged at the columns 12, 16 represent the separating point between the transfer systems 26, 27. The bottom dies which are disposed in front of the separating point and corresponding to the sliding table 19, via which they are accommodated, have the reference symbol 19'. Similarly, the bottom dies arranged behind the separating point, corresponding to the sliding table 20 via which they are accommodated, have the reference numbers 20' and 20" and are shown by a rectangle to indicate their outer contour. The bottom die 19'is used, for example, for removing a drawing edge on the workpiece, W, and is relatively narrow. Because of the edge existing on the workpiece W, however, it is relatively long in the X-direction. In contrast, the bottom die 20' is used, for example, for separation, i.e., cutting apart of the workpiece W, into two workpieces Wa and Wb which are to be machined further in the bottom die 20".

The bottom dies 20' and 20" have a larger transverse dimension, i.e., a larger width than the bottom die 19". However, their length measured in the transport direction (X-direction) is shorter. Although lateral free space left open by the bottom die 19' is needed by the gripper rails 31, 32 for gripping and releasing movement thereof in the Z-direction, the transport rails 51, 52 are spaced widely from one another and expose a maximal lateral space for the bottom dies 20', 20". A space F exists between the bottom dies 20', 20" to make possible a bringing of individual traverses 61, 62 into a waiting position during an operating stroke of the slides assigned to the respective bottom dies 20', 20". Although the transfer system 26 maximally utilizes the space existing laterally of the bottom die 19', the transfer system 27 also utilizes the space which exists anyhow between the bottom dies 20', 20" so that the multistation transfer press 1 can be constructed in a space-saving and compact manner which permits considerable cost savings.

Figure 3:
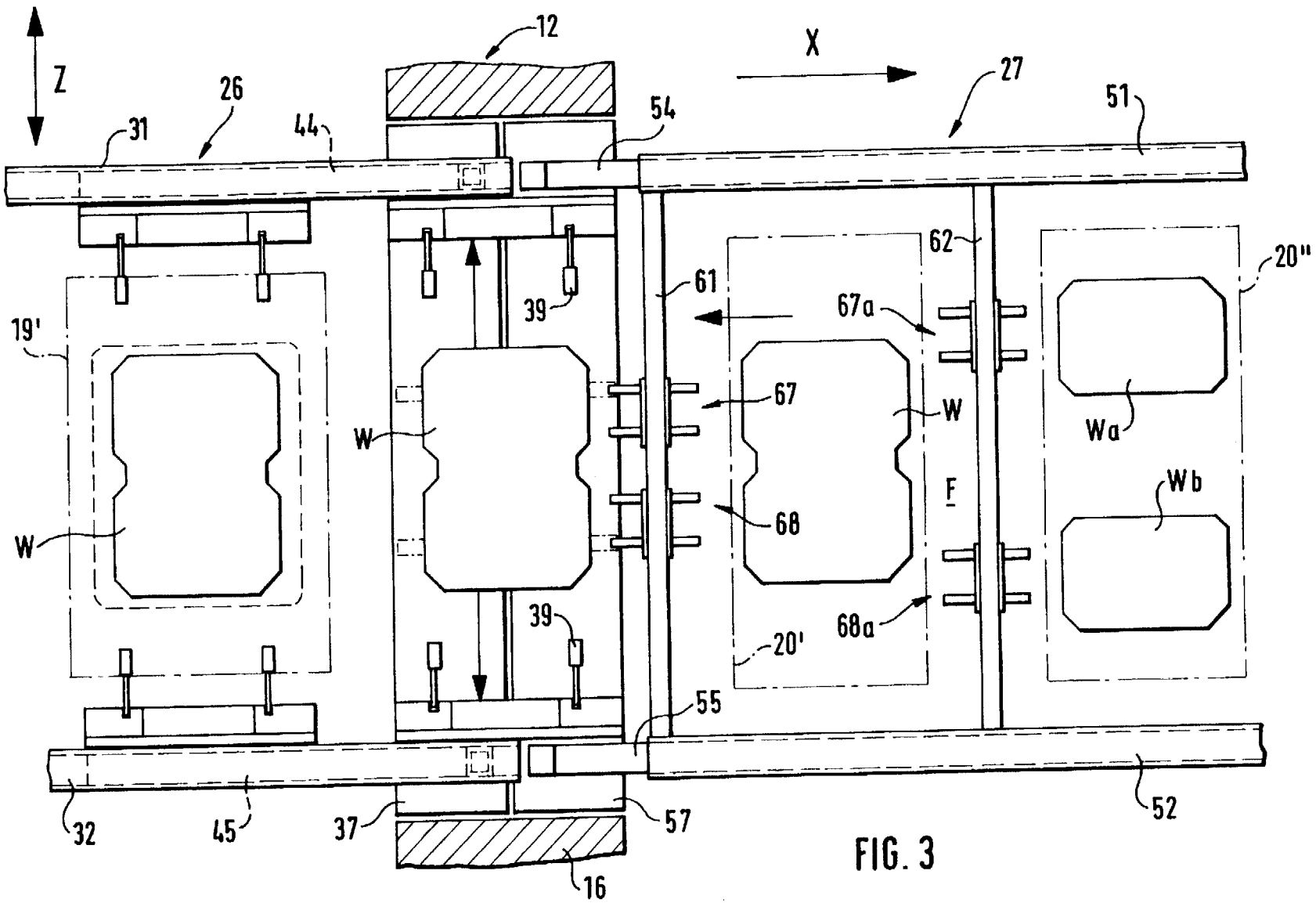
FIG. 3 is a schematic view of the press according to FIG. 2 but in a different operating position.

During the operation of the multistation transfer press 1, starting out from an initial position A in the transfer curve illustrated in FIG. 2, in which the workpieces W are deposited in the positions shown, the grippers 39 of the gripper rails 31, 32 are moved toward the outside in the Z-direction and are thus separated from the workpieces W. This position, in which the grippers 39 are separated from the workpiece W, in the left part of the transfer curve in FIG. 2 is marked S and is illustrated in FIG. 3. At the same time, the transport rails 51, 52 move through a slight lifting/lowering movement in the Z-direction as well as a movement opposite the X-direction which brings the traverse 61 out of its initial position A into a parked position marked P on the transfer curve as illustrated in FIG. 3.

The transport rails 51, 52 and therefore the traverses 61, 52, 63 must rest during the press stroke, but the gripper rails 31, 32 which were separated laterally from the workpieces W and with their grippers 39 are not in the press area, can move gradually toward a return point marked R on the transfer curve in FIG. 2. This movement can take place in a precision or energy-optimized manner.

Figure 4:
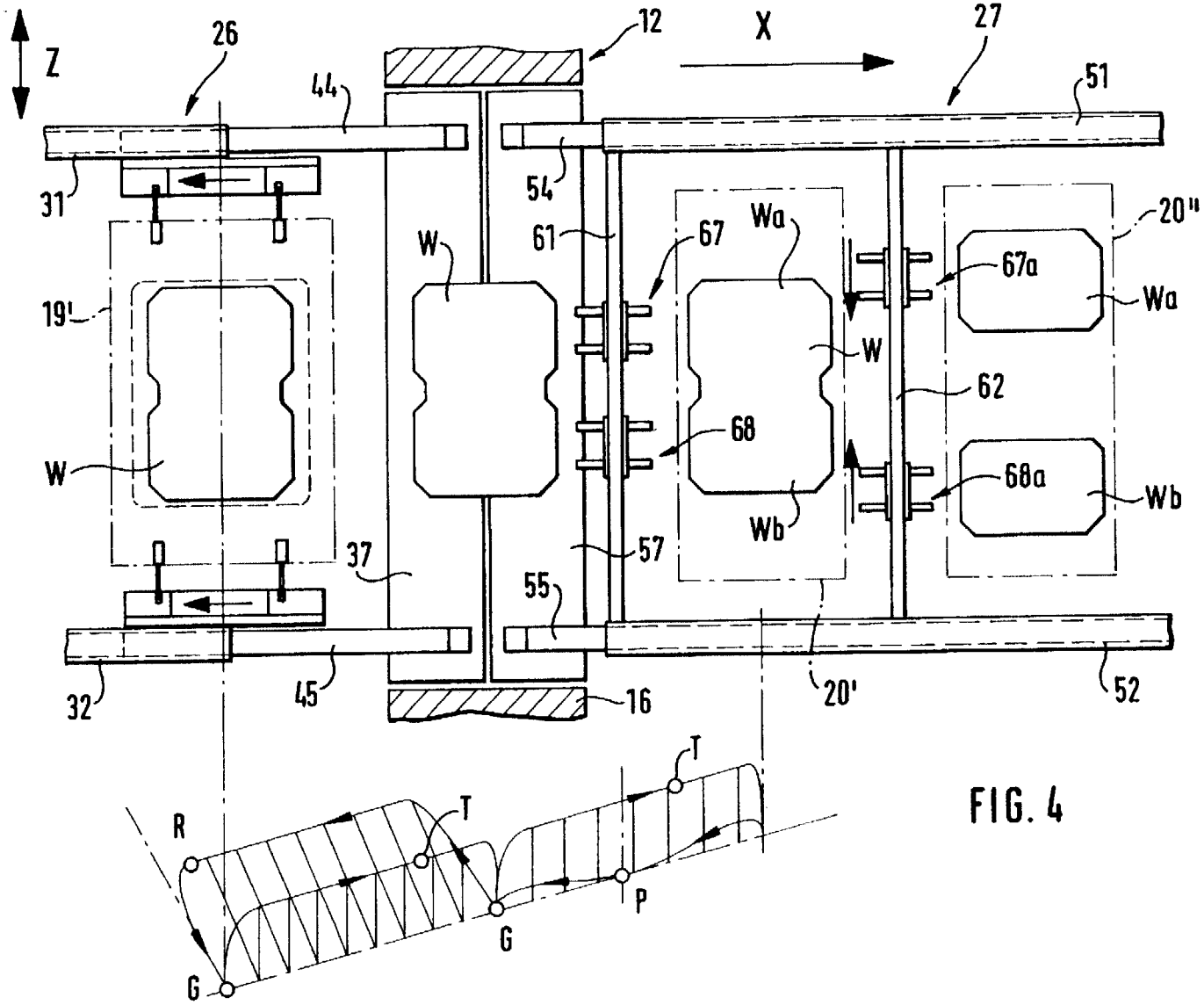
FIG. 4 is a schematic view of the press according to FIG. 2 and a diagrammatic representation of the transfer curve in a further operating position.

As illustrated in FIG. 4, starting from return point R on the transfer curve, the gripper rails 31, 32 of the transfer system 26 start a feeding movement extending in the Z-direction in order to engage at point G the grippers 39 with the next workpiece W which is situated in the bottom die 19'. When this movement is completed, The gripper rails 31, 32 will be in the position illustrated in FIG. 5. At the same time, the traverses 61, 62 start to move out of their parked position illustrated in FIG. 4 into a gripping position marked G on the transfer curve. A slight lifting/lowering movement in the Y-direction is superimposed on this movement which takes placed essentially opposite the transport direction in the X-direction. While, in this case, the vacuum grippers 67, 68 rest relative to the traverse 61, the vacuum grippers 67*a*, 68*a* are moved toward one another in order to be able to receive the workpiece W situated in the bottom die 20'.

Figure 5:
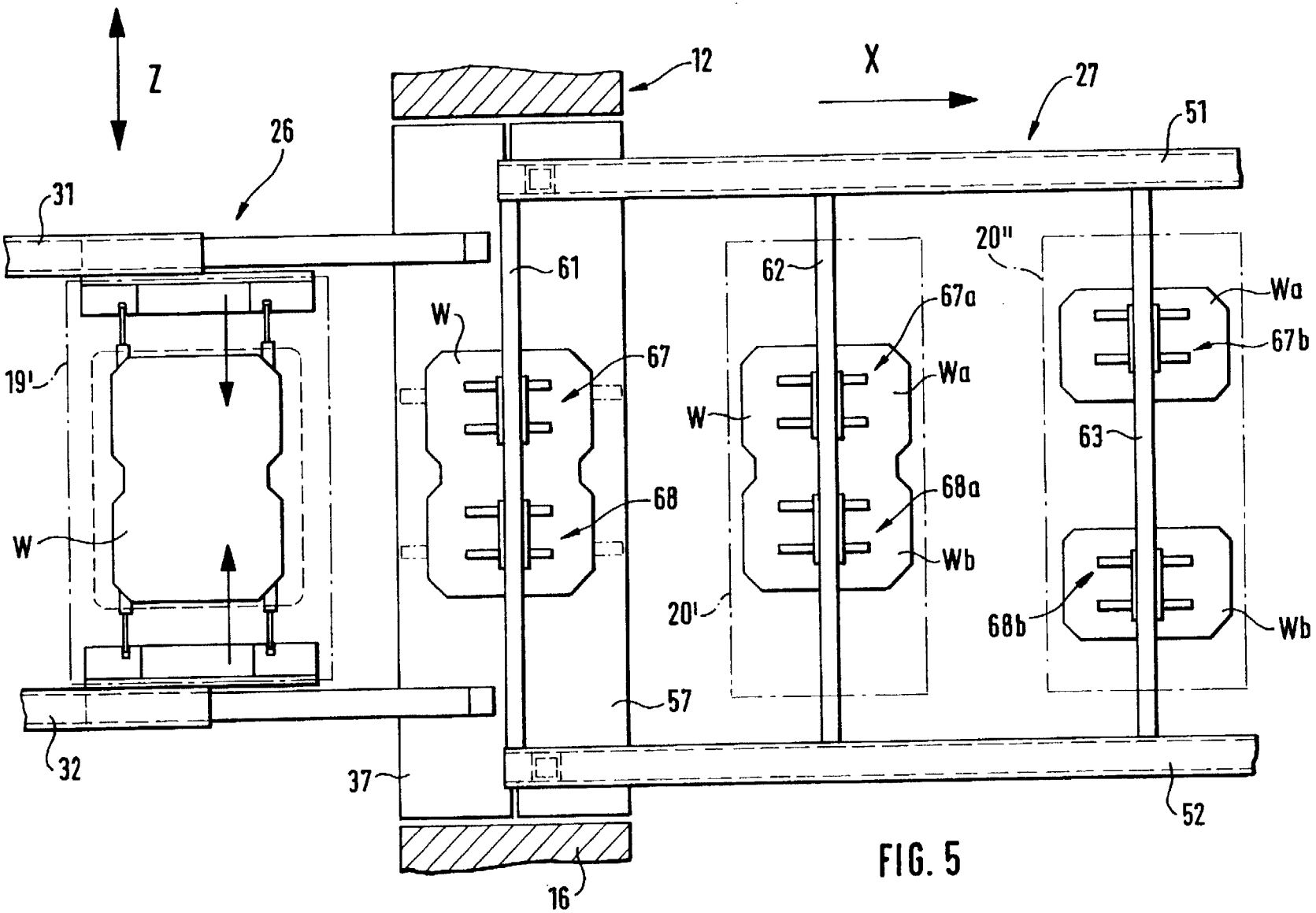
FIG. 5 is a schematic view of the press according to FIG. 2 in a final working position which precedes the working position illustrated in FIG. 2.

When the vacuum grippers 67, 68, 67*a*, 68*a* are lowered onto the workpieces, the position of the transfer system 27 illustrated on the right in FIG. 5 is reached. Starting from this position, the gripper rails 31, 32 of the transfer system 26 as well as the transport rails 51, 52 of the transfer system 27 move through a lifting-advancing-lowering movement. This movement transfers the workpiece W from the bottom die 19', which corresponds to the gripping position marked G in the left half of the transfer curve of FIG. 4, into the deposited position which is situated precisely above the closing boxes 37, 57. In the transfer curve illustrated in FIG. 2, this position A is in the center. The corresponding curve branch of the transfer movement is marked T in FIG. 4. The same applies to the movement of the transfer system 27 which transfers the workpiece W from the deposited position above the closing boxes 37, 57 into the bottom die 20' and thus returns to the starting point A in FIG. 2. The corresponding branch of the transfer curve is marked T in FIG. 4. The transport cycle of the transfer unit 24 described thus far is cyclically repeated in the timing of the machine.

In summary, a press with several press stations 3, 5, 7, 9, which are preferably provided for the serial machining of larger sheet metal parts, provides a transfer unit for transporting the workpieces through the press stations 3, 5, 7, 9 arranged behind one another in a machining sequence. The transfer unit has a first section 26 constructed as a three-axis transfer, and second section 27 constructed as a cross-traverse transfer. The three-axis transfer has a pair of parallel gripper rails which have gripper devices that, by way of a lateral feeding movement of the gripper rails, can be engaged with and disengaged from the workpieces. For this purpose, the gripper rails require a certain lateral space. In contrast, the cross-traverse transfer requires parking positions between individual press stations in which the cross-traverses remain during the operation of the press stations. In the first press section, on one hand lateral spaces next to the sliding tables exist anyhow, whereas in the second press section, on the other hand, parking positions can be provided for the cross-traverse because of the shorter bottom dies without any enlargement of the press. The combination of the three-axis transfer with the cross-traverse transfer permits a respectively adapted, good space utilization in the entire press area.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A press having a plurality of press stations for serially machining workpieces such as large sheet metal parts in the press stations which are arranged along a transport direction, comprising substantially parallel gripper rails arranged parallel to the transport direction, a first driving apparatus for moving the gripper rails toward and away from one another in a second direction, with a constant spacing in a lifting direction situated at a right angle with respect to the transport direction, and in the transport direction, a first set of gripper devices arranged to be carried by the gripper rails and engageable with and disengageable from the workpieces, a plurality of parallel transport rails arranged in a second press area downstream of the gripper rails as viewed in the transport direction, second driving apparatus operable independently of the first drivinq apparatus for moving the transport rails at a constant spacing with respect to one another in the lifting direction and in the transport direction, traverses arranged substantially transversely to the transport direction and are held on an end side thereof on the transport rails, and a second set of gripper devices arranged on the traverses to connect the transport rails.

2. The press according to claim 1, wherein the first driving apparatus and the second driving apparatus are independently driven.

3. The press according to claim 1, wherein the first driving apparatus have a lifting and closing device for the movement toward and away from one another in the second direction and for movement in the direction in which the gripper rails have a constant spacing.

4. The press according to claim 1, wherein the first driving apparatus contains an advancing device for driving the gripper rails in and opposite the transport direction.

5. The press according to claim 3, wherein a linear guide for uncoupling from an advancing device of the first driving apparatus is arranged between the lifting and advancing device of the first driving apparatus and the gripper rail, and the advancing device drives the gripper rails along the transport direction.

6. The press according to claim 1, wherein the first set of gripper devices is fastened to supports detachably fastened to the gripper rails.

7. The press according to claim 1, wherein the traverses are detachably connected with the transport rails, by movement away from one another in the second direction.

8. The press according to claim 7, wherein the second driving apparatus comprises a lifting and closing device for movement toward one another and away from one another in the second direction, and for the movement in the lifting direction during which the transport rails have constant spacing.

9. The press according to claim 1, wherein the second driving apparatus comprises an advancing device for driving the transport rails along the transport direction.

10. The press according to claim 8, wherein a linear guide for uncoupling from an advancing device of the second driving apparatus is arranged between the lifting and closing device and the carrier rail, and the advancing device is configured to drive the transport rails along the transport direction.

11. The press according to claim 1, wherein, the gripper rails have an approached position constituting a gripping position for engaging with the workpieces, and a spaced release position for non-engagement with the workpieces, and a distance between the gripper rails in the release position coincides substantially with a distance between the transport rails.

12. The press according to claim 1, wherein the gripper rails comprise a first transfer system and the transport rails comprises a second transfer system, with the first transfer system arranged upstream with respect to the second transfer system as viewed in the transport direction.

13. The press according to claim 12, wherein a transfer curve through which the first transfer system travels deviates form a transfer curve through which the second transfer system travels.

14. The press according to claim 13, wherein the first and second transfer systems are arranged such that the transfer curves thereof are coordinated.

15. The press according to claim 13, wherein the first transfer system is arranged in a press area in which the workpieces, measured transversely to the transport direction, have a smaller width.

16. The press according to claim 13, wherein the first transfer system is arranged in a press area in which the workpieces to be transported have a greater length.

17. The press according to claim 1, wherein movement in the lifting direction is carried out with a constant spacing of the gripper rails corresponds in magnitude to the corresponding movement in the lifting direction of the transport rails.

18. The press according to claim 1, wherein at least one set of the gripper rails and the transport rails are constructed to span a plurality of press stations.

19. The press according to claim 1, wherein the second set of gripper devices are displaceably arranged transversely to the transport direction.

20. The press according to claim 19, wherein each of the second set of gripper devices are connected with an adjusting system to permit a targeted movement of each of the gripper devices with respect to one of the traverses.

* * * * *